US009714069B2

(12) United States Patent
Garelick et al.

(10) Patent No.: US 9,714,069 B2
(45) Date of Patent: Jul. 25, 2017

(54) MOUNT FOR REMOVABLE SUPPORT PEDESTAL

(71) Applicants: Richard J. Garelick, Minneapolis, MN (US); Todd William Moore, Rosemount, MN (US)

(72) Inventors: Richard J. Garelick, Minneapolis, MN (US); Todd William Moore, Rosemount, MN (US)

( * ) Notice: Subject to any disclaimer, the term of this patent is extended or adjusted under 35 U.S.C. 154(b) by 64 days.

(21) Appl. No.: 14/832,270

(22) Filed: Aug. 21, 2015

(65) Prior Publication Data

US 2016/0075411 A1 Mar. 17, 2016

Related U.S. Application Data

(60) Provisional application No. 62/051,524, filed on Sep. 17, 2014.

(51) Int. Cl.
*B63B 29/06* (2006.01)
*B63B 29/04* (2006.01)

(52) U.S. Cl.
CPC ..... *B63B 29/06* (2013.01); *B63B 2029/043* (2013.01)

(58) Field of Classification Search
CPC ..... B63B 29/06; B63B 2029/043; B63B 2029/046
USPC ..... 114/363
See application file for complete search history.

(56) References Cited

U.S. PATENT DOCUMENTS 4,269,534 A * 5/1981 Ryan ..... E01F 9/681 256/1
5,197,406 A * 3/1993 Rabal ..... B63B 29/04 114/253
5,775,251 A * 7/1998 Morningstar ..... B63B 29/06 114/363
5,848,502 A * 12/1998 Schaefer ..... E01F 9/685 248/156
7,013,831 B1 3/2006 Garelick
7,331,305 B2 * 2/2008 Garelick ..... B63B 29/04 114/363
8,398,036 B2 * 3/2013 Svedberg ..... E04G 21/3223 248/154

* cited by examiner

*Primary Examiner* — Ajay Vasudeva
(74) *Attorney, Agent, or Firm* — Jacobson and Johnson

(57) ABSTRACT

A base member attached to a supporting surface has an open top cavity in the general shape of a shoe and a base assembly housing, which is attached to the lower end of a rigid pedestal which supports an apparatus at its upper end, is foot shaped in part to nestle in the base member shoe area. A manually operable securing device releasably secures the housing snugly in the base member so that the pedestal is readily attached and removed as necessary.

7 Claims, 4 Drawing Sheets

MOUNT FOR REMOVABLE SUPPORT PEDESTAL

CROSS REFERENCE TO RELATED APPLICATIONS

This application claims priority to U.S. Provisional Application Ser. No. 62/051,524; filed on Sep. 17, 2015; titled DETACHABLE PEDESTAL SUPPORT BASE.

FIELD OF THE INVENTION

The invention is aimed at the recreational boat industry in which boat apparatus or accessory, such as one or more boat seats or table tops or the like, are mounted on and elevated from the boat deck. Naturally, stability of the mounting device when the boat is in operation is of great importance. Yet there are many instances when much of the deck needs to be cleared, at least temporarily, of the apparatus. Therefore it is also important that the apparatus be secured firmly in place when in use and yet be conveniently removable from its mounting device. The instant invention is a system, which provides these features at a reasonable cost.

STATEMENT REGARDING FEDERALLY SPONSORED RESEARCH OR DEVELOPMENT

None

REFERENCE TO A MICROFICHE APPENDIX

None

BACKGROUND OF THE INVENTION

Conventionally, recreational boat apparatus or accessories, as mentioned hereinabove, are attached to the boat deck by a flush mount or a surface mount. The former necessitates a recess in the boat deck so that when the apparatus is removed the mounting device does not extend above the surface of the boat deck. The latter requires a mounting plate or base plate resting on and secured to the surface of the boat deck. A low profile mounting plate is preferable. It may be described, as the phrase suggests, as not extending much above the deck when the accessory is removed so that it does not interfere with or be an obstacle or impediment to anyone or anything on the deck The instant invention deals with the latter type of mounting device or system which is widely used in the recreational boating industry.

U.S. Pat. No. 7,331,305 illustrates the underside of a maneuverable boat seat coupled to the upper end of a vertical pedestal or stanchion. At its lower end the pedestal is removably attached by a base assembly to a low profile base plate, which is fixedly secured to the surface of the boat deck. Briefly, bolt members are inserted into keyway slots to engage the base assembly at the lower end of the pedestal to the fixed base plate, and a pair of manually operable lever arms are used to releasably lock the base assembly, along with the pedestal, to the base plate.

U.S. Pat. No. 7,013,831 illustrates and describes another device or system for releasably mounting a recreational boat apparatus to a low profile mounting plate or base. A base assembly at the lower end of the mounting pedestal has clamping rods or bolts to engage curved slots in the low profile base plate, which is fixedly attached to the boat deck. The pedestal is twisted or turned to mate the base assembly securely to the base plate and a pair of lever arms are manually operated to releasably lock the pedestal in place.

The advent of some changes in the present day recreational boating industry has created a need for more secure mounting of the boat apparatus or accessories. Improvements and/or or changes in the boat designs have made them slicker and faster and more maneuverable. Increased engine horsepower has substantially increased the speed and thrust of the boats and the resulting forces on the boat. Also, increased participation in competitive events is another reason that elevated apparatus and accessories mounted on the boat deck are subject to increased forces on the mounting devices and systems so they need increased mounting security against the increased forces, which otherwise would cause wobbling when in use.

BRIEF SUMMARY OF THE INVENTION

Conventionally, recreational boats have elevated apparatus or accessories mounted on the boat deck. Typically these may be adjustable or maneuverable boat seats for the pilot or operator and/or passengers, tabletops, and for possible electronic or guidance equipment. The apparatus is elevated by attachment to the upper end of a pedestal or stanchion which has its lower end removably secured to the boat deck. The invention provides a rigid base plate, preferably a low profile base plate, attached to a boat deck with the base plate having an upwardly open cavity with tapered and untapered walls. A base assembly housing fixedly attached as an integral part of the other or lower end of the pedestal or stanchion has corresponding tapered and untapered walls for resting in the cavity and snugly engaging the corresponding cavity walls in the base plate. A manually operable locking mechanism releasably secures the housing within the confines of the cavity with the respective walls in secure snug uniform engagement with one another. In an embodiment of the invention the base plate and the base plate assembly may be casted, molded, or machined to obtain compatible close tolerance engagement surfaces to assure a snug and secure engagement when locked together.

DESCRIPTION OF THE PREFERRED EMBODIMENT

Typically and conventionally a boat apparatus or accessory such as a boat seat 10 is coupled to the upper end of a vertically disposed pedestal or stanchion 11 by a mechanism 12, not pertinent to the instant invention, which allows the user to move the seat back and forth and rotationally.

Figure 1:
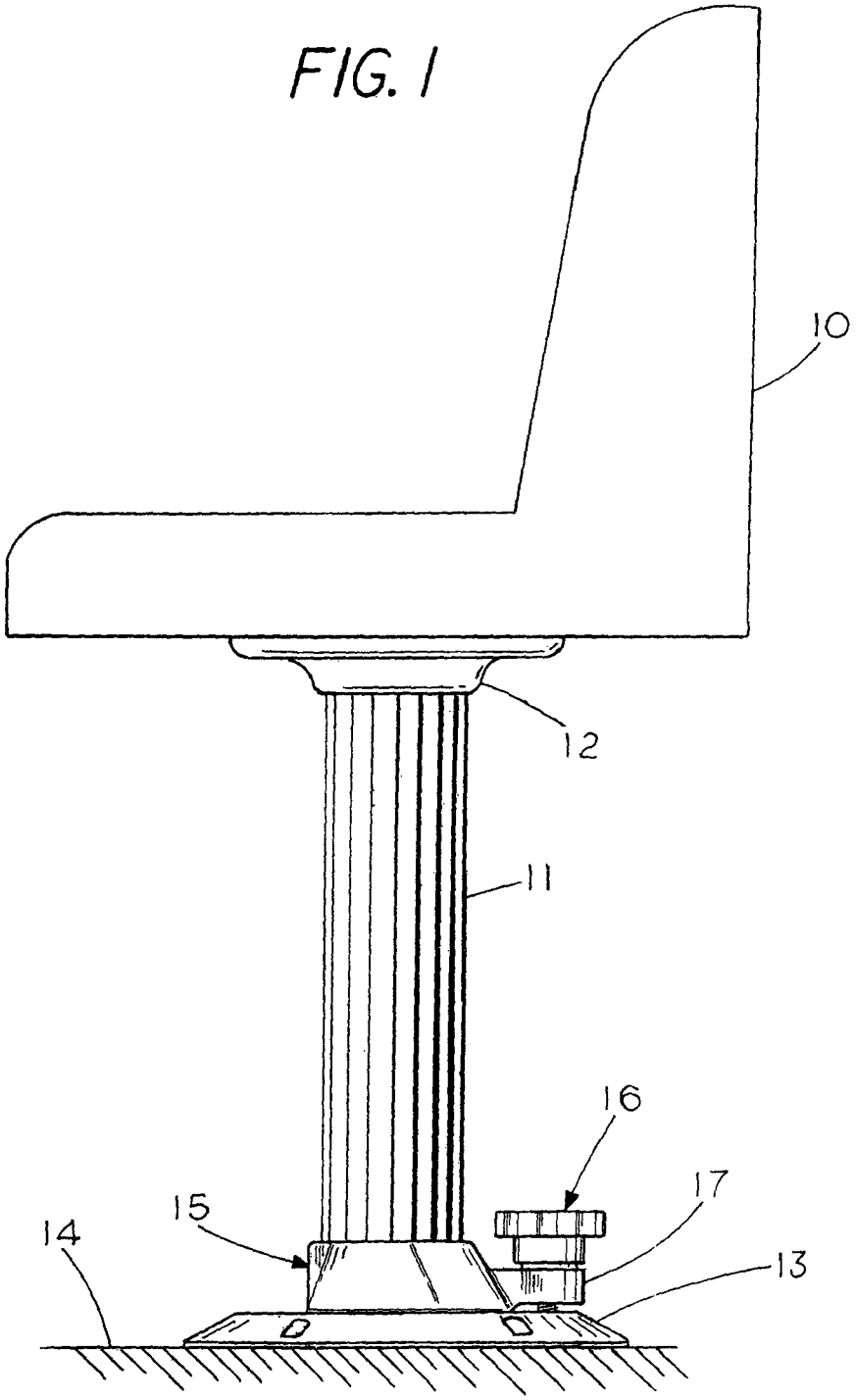
FIG. 1 is an illustration of an embodiment of the invention for securely mounting an elevated boat seat on a supporting surface such as a boat deck.

Oftentimes, means, not shown, are provided to change the elevation of the apparatus. The FIG. 1 embodiment illustrates a base plate 13 on a supporting surface, such as a boat deck 14. A base assembly 15 fixedly attached to the lower end of pedestal 11 is engaged with base plate 13 and a manually operable locking mechanism 16 for releasably securing base assembly 15 to base plate 13 is attached to a ledge 17 extending from base assembly housing 15.

Figure 2:
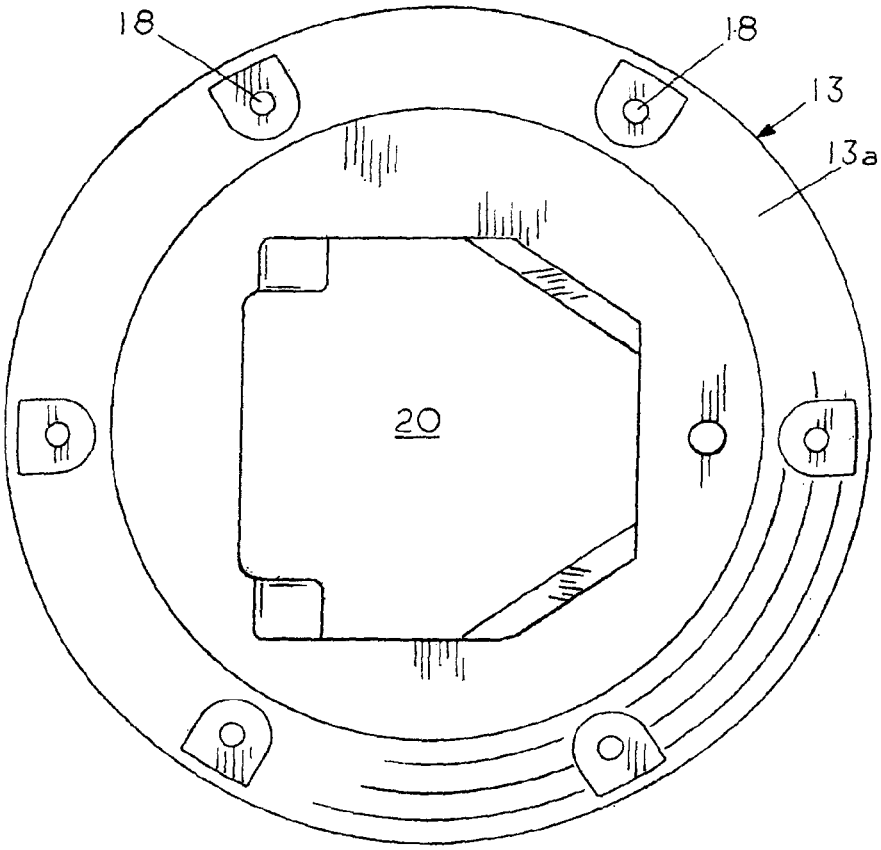
FIG. 2 is a top view of a base plate for mounting on a supporting surface.
Figure 3:
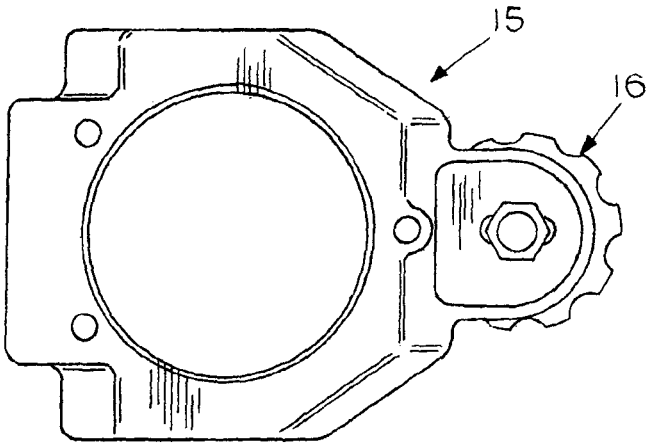
FIG. 3 is an underside view of a base assembly housing for engaging the base plate cavity.
Figure 4:
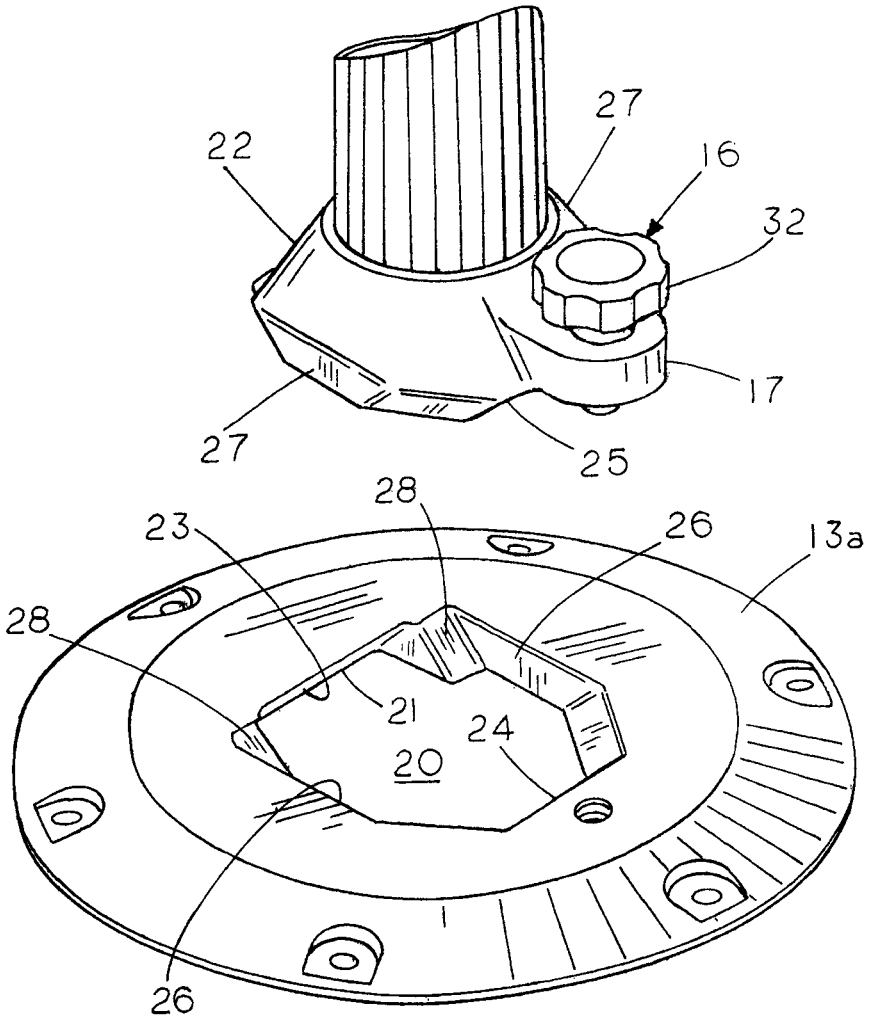
FIG. 4 is a perspective view of FIGS. 2 and 3 showing more clearly some of the mating surfaces of an embodiment of the invention.
Figure 5:
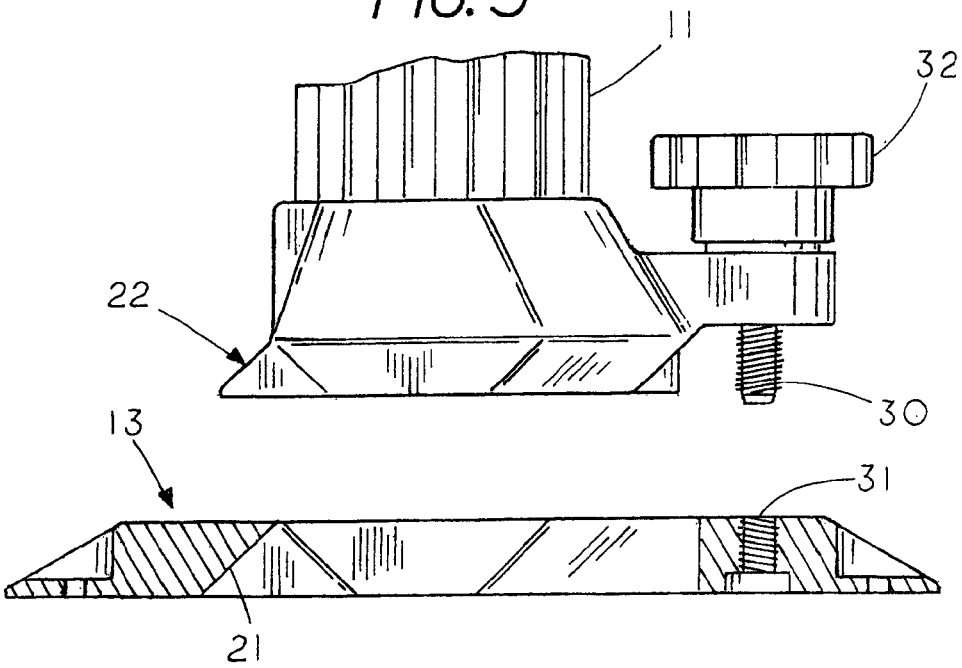
FIG. 5 is a partly sectioned view showing in greater detail some of the engaged surfaces when the base assembly is coupled to the base plate; and, FIG. 6 is a similar view with the base assembly in secured engagement with the base plate.
Figure 6:
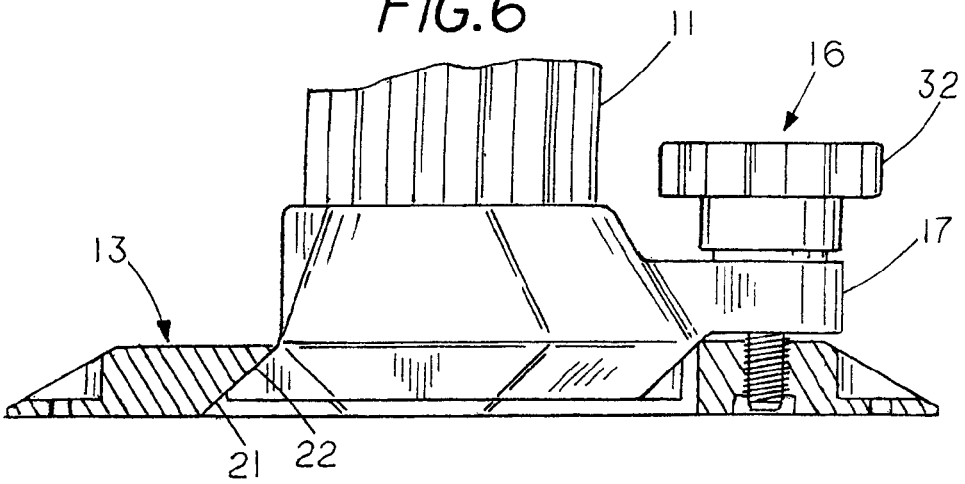

FIG. 2 is a top view of base plate 13 and FIG. 3 is an underside view of base assembly 15 without its normally integral attachment to a pedestal or stanchion. The embodiment depicted in the drawings illustrate a circular rim or ring 13*a* by which the base plate is attached to a supporting surface such as boat deck 14 via bolts or the like, not shown, in openings 18. The outer configuration of base plate ring 13*a* in the illustrative embodiment is not intended to be limitive. The configuration may be circular as shown or rectangular or other geometric design provided that it has the essential features as called for by the invention as described herein. The interior walls in cavity 20 of base plate 13 into which base assembly 15 is inserted are configured to provide close or intimate contact with the corresponding configured walls of the base assembly when the two are coupled together. Outwardly tapered inner wall 21 of cavity 20 is configured to form a recess 23 to receive a similarly tapered extending wall 22 of base assembly 15. Directly rearward therefrom inner wall 24 of cavity 20 is configured to make intimate contact with wall 25 of base assembly 15. In similar fashion the inner sidewalls 26 of cavity 20 and the corresponding outer walls 27 of base assembly 15 are configured to make intimate contact with one another when coupled together.

Threaded member 30 engaged with threaded opening 31 when operated manually by knob 32 releasably locks the two mounting members together by applying forces on the mounting members 15 and 13 to produce a slight degree of translational motion drawing their respective surfaces together to produce a firm and snug engagement. The open top cavity forms or provides a shoe area in the base plate having a toe receiving front recess 23 and a heel receiving rear area and enclosing side walls to mate with frontward toe projection 22 and a rearward heel area along with the enclosing walls of base assembly 15. Correspondingly, housing 15 provides a foot, with toe and heel, which is snugly engaged within the base plate shoe area when joined together. In addition, inwardly tapered flats or rests 28 at each end of recess 23 also serve to provide intimate contact between base 13 and base assembly 15 when they are secured to one another. The close intimate contact of the corresponding surfaces of the two coupled and secured mounting members provides the increased security for mounting elevated accessories and apparatus when needed yet providing a relatively convenient manner of removal when necessary.

We claim:

1. A device for removably mounting a boat accessory to a boat deck, comprising:

a) a rigid base plate fixedly attached to the surface of a boat deck, said base plate having an upwardly open cavity, the walls of said cavity defining a shoe area having an outward tapered toe receiving recess in one wall, an inwardly tapered heel receiving opposite wall, and generally parallel side walls enclosing the shoe area;

b) a rigid pedestal, the upper end of said pedestal adapted to engage and support the underside of a boating accessory;

c) a housing fixedly attached to the lower end of said pedestal said housing enclosing a foot having a toe member for resting in the cavity recess and a heel member for snugly engaging the heel receiving wall of said cavity; and, d) manually operable means coupled to said housing and to said base plate for releasably securing said housing foot within said shoe area.

2. A device for removably mounting a boat accessory to a boat deck as described in claim 1 further including parallel rests on each side of said toe receiving recess for engaging corresponding surfaces of said housing shoe.

3. A device for removably mounting a boat accessory to a boat deck as described in claim 1 wherein said manually operable securing means is attached to a ledge extending outward from the heel area of said housing and is coupled to said base plate.

4. A device for removably mounting a boat accessory to a boat deck as described in claim 3 wherein said manually operable securing means comprises a member extending from said ledge into engagement with said base plate, said member manually operable to move said housing foot vertically into said base plate shoe.

5. A device for removably mounting a boat accessory to a boat deck as described in claim 4 wherein the vertical movement of said housing produces a translational movement of said foot within the shoe area of said base plate.

6. A device for removably mounting a boat accessory to a boat deck as described in claim 4 wherein said manually operable member comprises a rigid elongated threaded member threadably engaged with said base plate.

7. A device for removably mounting a boat accessory to a boat deck as described in claim 1 wherein said housing and said base plate are formed by die-casting.

* * * * *